US005460108A

United States Patent [19]

Migliorini

[11] Patent Number: 5,460,108

[45] Date of Patent: Oct. 24, 1995

[54] METHOD AND APPARATUS FOR THE AUTOMATIC LOADING OF A MACHINE FOR SEWING GUSSETS ON PANTYHOSE-TYPE HOSIERY ARTICLES

[75] Inventor: Pier L. Migliorini, Arezzo, Italy

[73] Assignee: Solis S.R.L., Tavarnuzze, Italy

[21] Appl. No.: 161,879

[22] Filed: Dec. 2, 1993

[51] Int. Cl.[6] ..... D05B 97/00

[52] U.S. Cl. ..... 112/475.12; 112/470.15

[58] Field of Search ..... 112/262.2, 262.1, 112/121.15, 262.3, 121.12, 121.29; 223/43

[56] References Cited

U.S. PATENT DOCUMENTS

| | | | |
|---|---|---|---|
| 4,516,513 | 5/1985 | Gazzarrini | 112/262.2 |
| 4,538,534 | 9/1985 | Frazier | 112/262.2 |
| 4,566,615 | 1/1986 | Nakahira | 112/262.2 X |

FOREIGN PATENT DOCUMENTS 504417 7/1981 Spain .

*Primary Examiner*—Peter Nerbun

*Attorney, Agent, or Firm*—McGlew and Tuttle

[57] ABSTRACT

Apparatus for the automatic loading of a machine for sewing gussets on pantyhose-type hosiery articles, comprising: a bodice-supporting tubular head (100) provided inside with an annular electrical resistance (9) and a suction conduit (8); means for vertically moving the head (100) alternatively in two directions, with an actuator cylinder (101) having vertical axis; means for alternatively moving the head (100) about a horizontal axis, with a cylinder (104) fixed to the carriage (103) and a lever (106) connected to the stem of the cylinder (104) and to the head (100); a collar (110) coaxially located above the head (100); pantyhose supporting means on each head of the gusset-sewing machine, with as many countercones (25), each of which being fitted on a vertical axis pipe (26) to the lower end of which a corresponding head (27) of the machine is fixed; pantyhose gripping means, with an elastic, annular, normally closed gripper (31) for each one of heads (27), which is supported by a corresponding countercone (25); fixed cam means (400) for driving said countercones (25) into an upward and respectively downward stroke; pneumatic means (450) for operating said grippers (31); and means for cutting and removing the waste generated during the trimming of the perineal hole, with an electrical resistance (40) and a suction pipe (38).

9 Claims, 13 Drawing Sheets

METHOD AND APPARATUS FOR THE AUTOMATIC LOADING OF A MACHINE FOR SEWING GUSSETS ON PANTYHOSE-TYPE HOSIERY ARTICLES

FIELD OF THE INVENTION

The present invention refers to a method and apparatus for the automatic loading of a machine for cutting gussets on pantyhose-type hosiery.

BACKGROUND OF THE INVENTION

An automatic apparatus is known from the Spanish patent No. 504417, which picks up the pantyhose article from a machine which sews two stockings making up the pantyhose article by means af an annular gripper, provided with elements radially stretchable apart, which engages the edge of the pantyhose seamless region intended to receive the gusset and, afterwards, transfers said stretched edge of the article onto the horizontal circular mouthpiece of the tubular head of a machine which applies and sews the gussets; thereafter, the article is aspirated inside the head by leaving outside a sufficient amount of fabric for the sewing of the gusset.

This, however, may give rise, especially for certain kinds of very delicate fabrics, to the formation of ladders due to the operation of the elements of said gripper, each of which exerts its action over a limited region of the fabric. In addition to this, there is the fact that said known apparatus does not allow the pantyhose articles to be loaded with their perineal region being completely closed.

SUMMARY AND OBJECTS OF THE INVENTION

The main object of the present invention is to overcome the above mentioned drawbacks.

This result has been achieved, according to the present invention, by providing an operative method which comprises:

- fitting a pantyhose article on a tubular support driven into a reciprocating vertical motion and, respectively, into a reciprocating rotary motion about a horizontal axis;
- disposing said support in vertical position and retaining the thus disposed pantyhose article closely adherent thereto by means of a stream of air aspirated from the inside thereof;
- lifting said support up to a level useful to allow the grip of the pantyhose article by the corresponding means activated by the same support;
- forming the perineal hole in the thus retained pantyhose article;
- aspirating the fabric resulting from said perineal hole of the pantyhose;
- lifting said support further up to dispose the respective pantyhose article in the position suitable for the gripping thereof by the corresponding means mounted on each of the heads of the gusset-sewing machine;
- activating said pantyhose-gripping means to allow the transfer thereof onto a corresponding head of the machine;
- breaking off the suction inside said tubular support;
- lowering said support thereby deactivating said pantyhose-gripping means;
- aspirating the pantyhose bodice inside the corresponding head of the machine;
- inclining said tubular support to allow a new pantyhose article to be fitted thereon;
- carrying out the trimming of said perineal hole;
- sewing the pantyhose-backing perineal gusset;
- turning the pantyhose article inside out;
- cutting and aspirating the annular portion of the fabric taken out by the trimming of the perineal hole;
- deactivating said pantyhose gripping means to allow the removal of the pantyhose article.

As far as the apparatus for implementing said method is concerned, it comprises:

- bodice support means for supporting the bodice of a pantyhose article, with a suction head of tubular shape which is internally provided with an electrical annular resistance element to carry out the perineal hole of the pantyhose article, and with a conduit to aspirate the thus removed fabric;
- pneumatic means to drive said tubular head into a reciprocating vertical motion;
- pneumatic means to drive said head into a reciprocating rotary motion about a horizontal axis;
- pantyhose bodice supporting means on each gusset-sewing machine head of the gusset-sewing machine, with as many "countercones" each of which is fitted on a vertical axis tube at the lower end of which a corresponding head is fixed;
- pantyhose gripping means, with a plurality of elastic annular grippers, each of which is supported by a corresponding countercone;
- fixed cam means to operate the rise and descent of said countercones;
- pneumatic means for activating said grippers, which pneumatic means are disposed in correspondence of the stations for the loading, and respectively the turning inside-out of the article;
- cutting and removing means for cutting and removing the waste generated during the perineal hole-trimming operation by the corresponding machine members, with a suction pipe and a corresponding electrical resistance, said means being disposed in correspondence of the station for the eversion of the article.

The advantages which derive from the present invention lie essentially in that it is possible to feed a gusset-sewing machine without causing ladders in the perineal region of the pantyhose article to which the gusset is sewn, even if it is very delicate; that said feeding is automatic and easily serviced by the operators; that it is possible to apply said gusset also to knitted pantyhose, as the grip of the pantyhose article in correspondence of the perineal region thereof is obtained by means of an annular gripper able to distribute the corresponding mechanical stress over a circular, continuous portion of the fabric, that is, without concentrating the engagement load over a discrete number of fabric portions of small surface extension.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
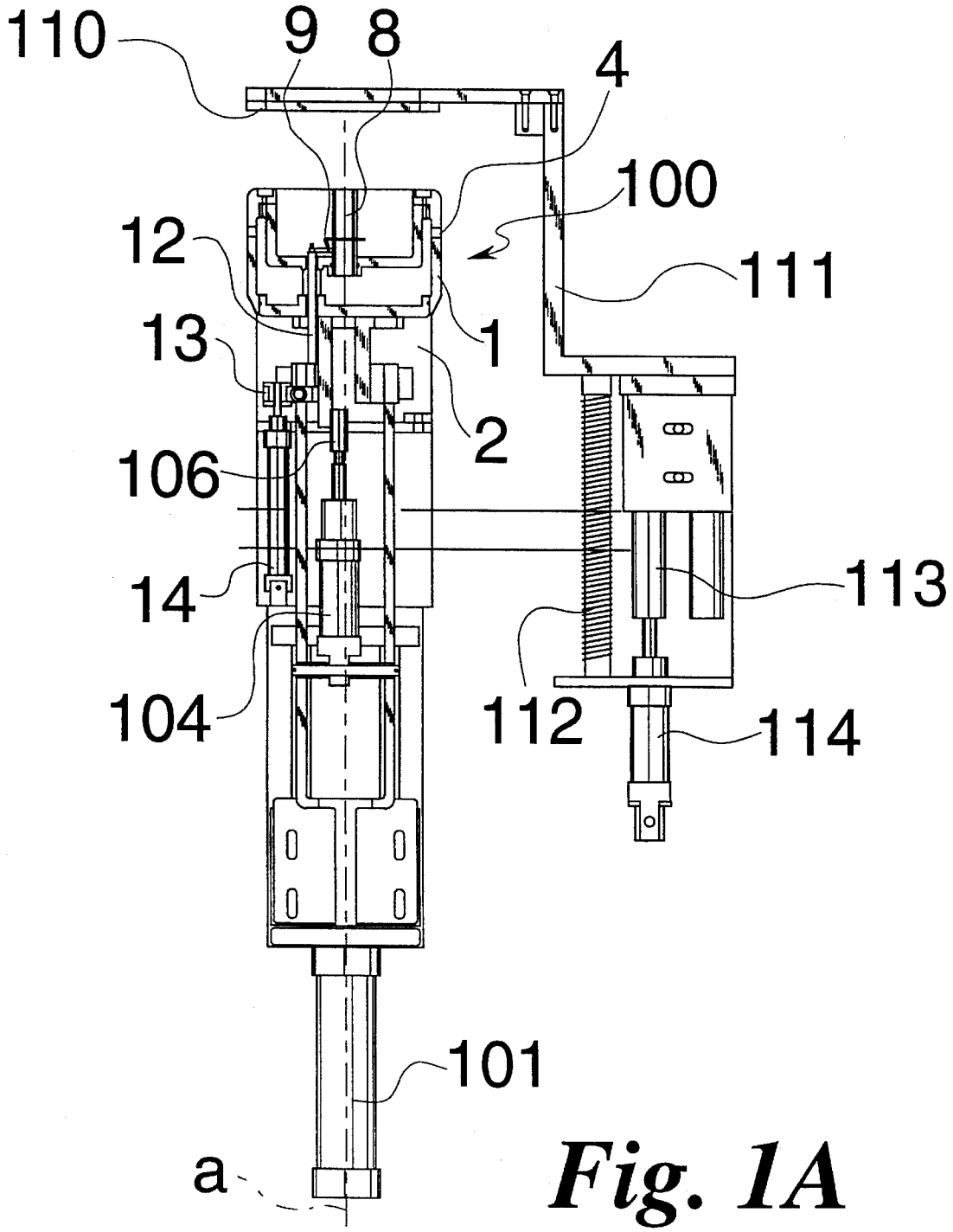
FIG. 1A is a view in longitudinal section of a head for supporting the pantyhose bodice in a rest condition, in an apparatus according to the invention.

Reduced to its basic structure and with reference to the figures of the attached drawings, a method for the automatic loading of a machine for sewing gussets on pantyhose-type hosiery articles according to the invention, comprises in sequence the following operating steps:

fitting a pantyhose article on a tubular support (100) driven into a reciprocating vertical motion and, respectively, into a reciprocating rotary motion about a horizontal axis;

disposing said support (100) in a vertical position and retaining the thus disposed pantyhose article closely adherent thereto by means of a stream of air aspirated from the inside thereof;

lifting said support (100) up to a level useful for the gripping of the pantyhose article by the corresponding means (110) activated through the same support (100);

carrying out the perineal hole in the thus retained pantyhose article;

aspirating the fabric resulting from said perineal hole of the pantyhose;

lifting said support (100) further up to dispose the respective pantyhose article in the position suitable for the gripping thereof by the corresponding means (25, 31) mounted on each of the heads of the gusset-sewing machine;

activating said pantyhose-gripping means (25, 31) to allow the transfer thereof onto a corresponding head (27) of the machine;

breaking off the suction inside said tubular support (100);

lowering said support (100) thereby deactivating said pantyhose-gripping means (110);

aspirating the pantyhose bodice inside the corresponding head (27) of the machine;

inclining said tubular support (100) to allow a new pantyhose article to be fitted thereon;

carrying out the trimming of said perineal hole;

sewing the pantyhose-backing perineal gusset;

turning the pantyhose article inside out;

cutting and aspirating the annular portion of the fabric taken out by the trimming of the perineal hole;

deactivating said pantyhose gripping means (25, 31) to allow the removal of the pantyhose article.

An apparatus for carrying out said method, according to the invention, comprises:

a tubular head (100) for supporting the bodice of a pantyhose article, with an annular chamber (1) connected to an intake manifold (2), with an annular electrical resistance element (9) to cut out the edge of the pantyhose hole provided for the gusset, and with a conduit (8) below the resistance (9) to suck the thus removed fabric;

means for vertically driving said head (100) into an alternate motion in the two directions, with a corresponding actuator cylinder (101) having a vertical axis and provided with a stem (102) fixed to the bottom of a carriage (103) for supporting the head (100);

means for driving into motion said head (100) about a horizontal axis, that is, orthogonal to the slide direction of the head (100), alternatively in the two directions, with a corresponding operating cylinder (104) fixed to the carriage (103) and with a lever (106) connected, at one end, to the stem of the cylinder (104) and, at the diametrally opposite end, to the head (100), so that the withdrawal, respectively, the feedback of said stem (105), will cause the clockwise, respectively, counterclockwise rotation of the lever (106) and, along with it, of the head (100);

a collar (110) coaxially mounted above said head (100) to grip the fabric mounted thereon, in cooperation with the suction inside the chamber (1), during the loading operation of the head (27) of the gusset-sewing machine: said collar (110) being fixed to a corresponding carriage (111) which is driven into a reciprocating vertical motion, that is, a lifting and respectively lowering motion, in synchronism with the lifting and respectively lowering of the head (100), so as to result in the condition of gripping the pantyhose article when the head (100) is lifted to feed the machine, and respectively in the condition of releasing the pantyhose article upon activation of the suction operated inside the head (27) of said machine;

pantyhose supporting means on each head of the gusset-sewing machine, with as many countercones (25), each of which is fitted on a vertical axis pipe (26) to the lower end of which a corresponding head (27) of the machine is fixed;

pantyhose gripping means, with an elastic, annular, normally closed gripper (31) for each head (27), which is supported by a corresponding countercone (25);

fixed cam means (400) for driving the lifting and lowering of said countercones (25);

pneumatic means (450) for operating said grippers (31), which means are disposed in correspondence of the stations for loading and respectively turning inside-out the article;

means for cutting and removing the waste generated during the trimming of the perineal hole, with an electrical resistance element (40) and a suction pipe (38) which are driven into a reciprocating motion close to and respectively away from the trimming station.

According to a preferred embodiment of the invention, the grip region of said gripper (31) is a circular crown provided with a plurality of longitudinal cuts.

Figure 1B:
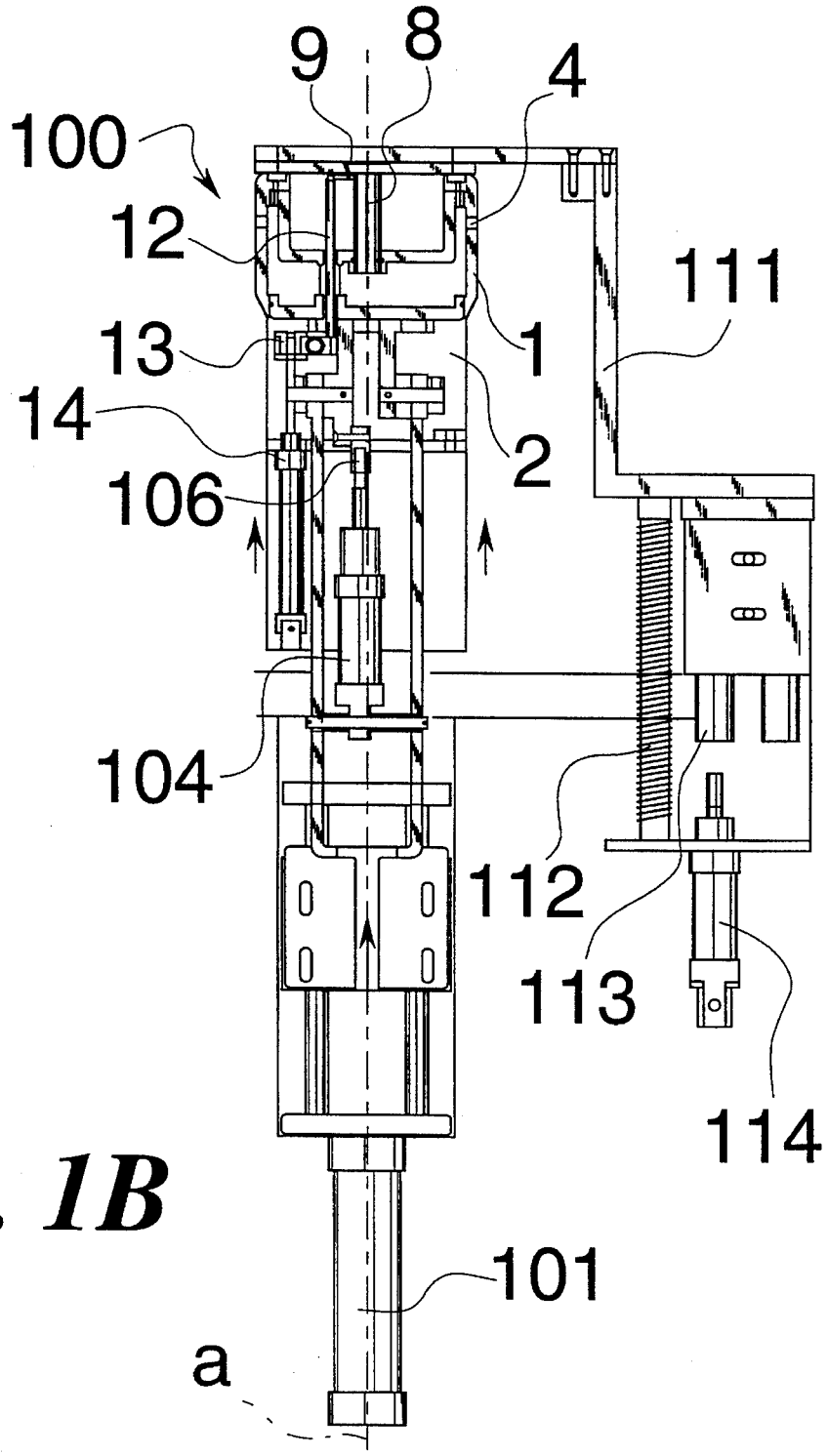
FIG. 1B shows a view in longitudinal section of the head of FIG. 1A as it forms the perineal hole on the relevant pantyhose article.
Figure 1C:
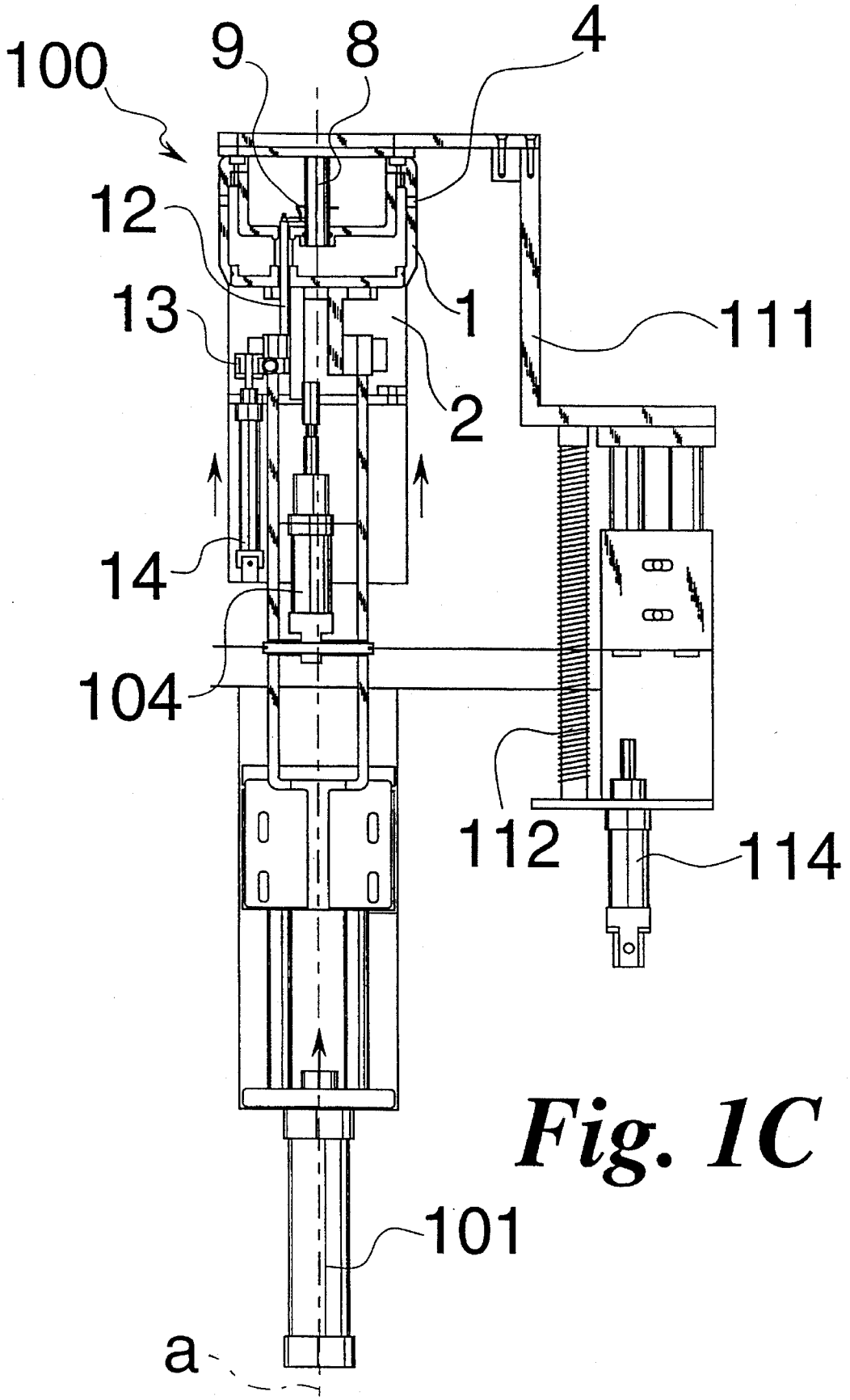
FIG. 1C is a view in longitudinal section of the head of FIG. 1A showing the transfer of the relevant pantyhose article to the corresponding head of the gusset-sewing machine.
Figure 1D:
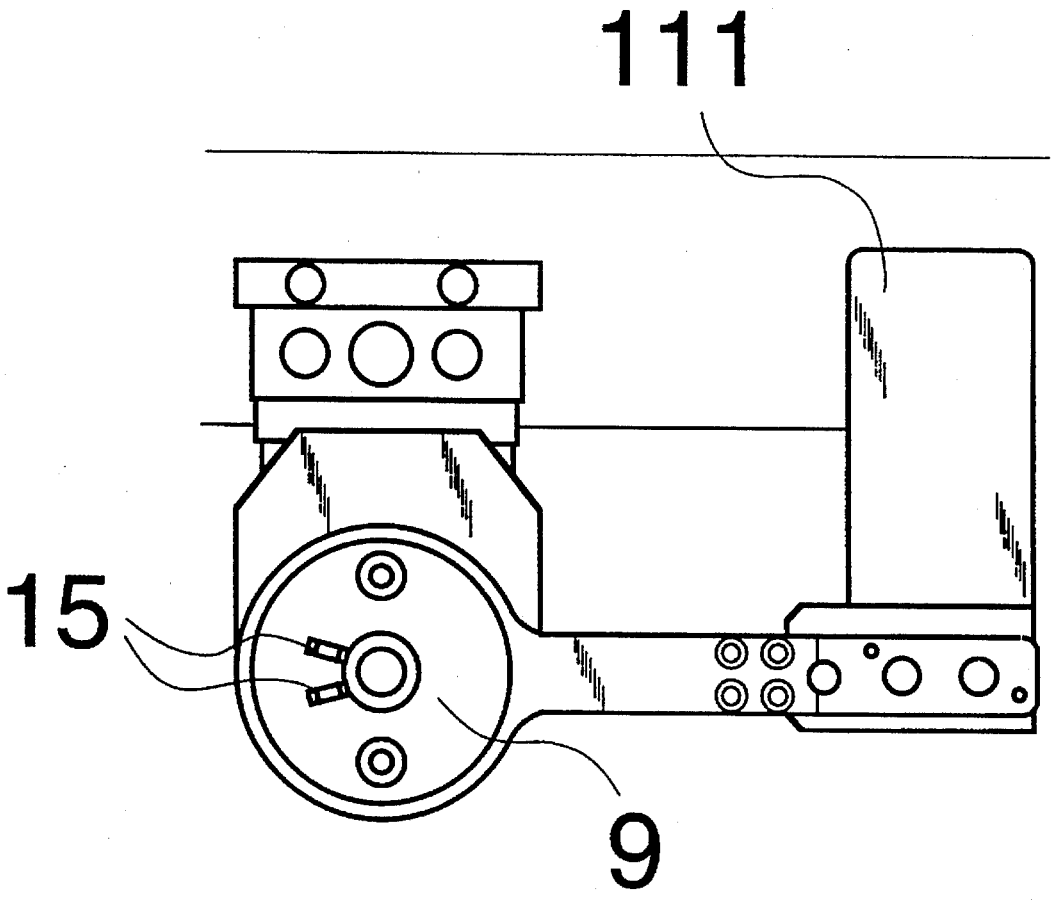
FIG. 1D shows the plan view of the head of FIG. 1C.
Figure 1E:
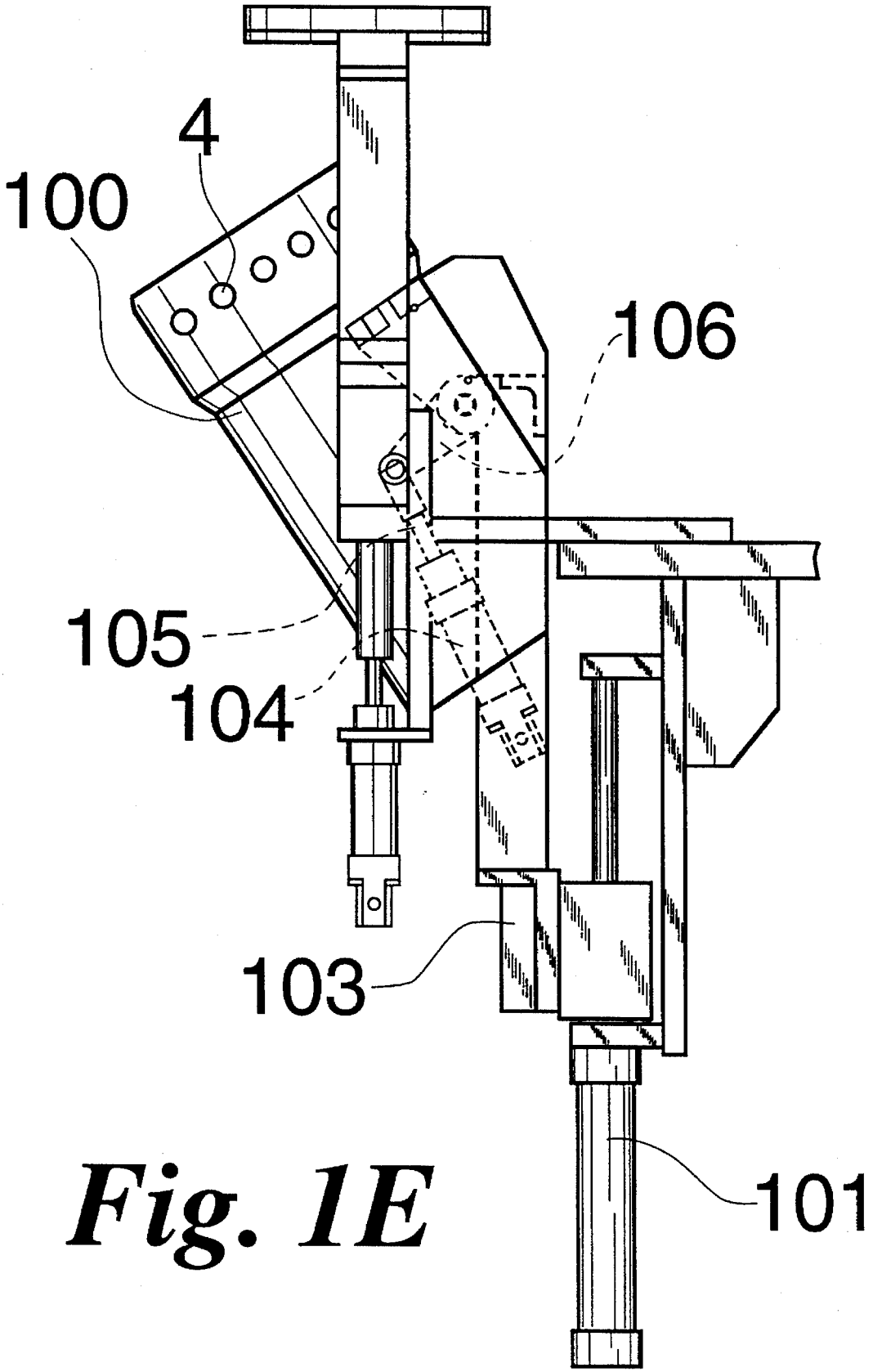
FIG. 1E shows a side view of the head of FIG. 1A.
Figure 1F:
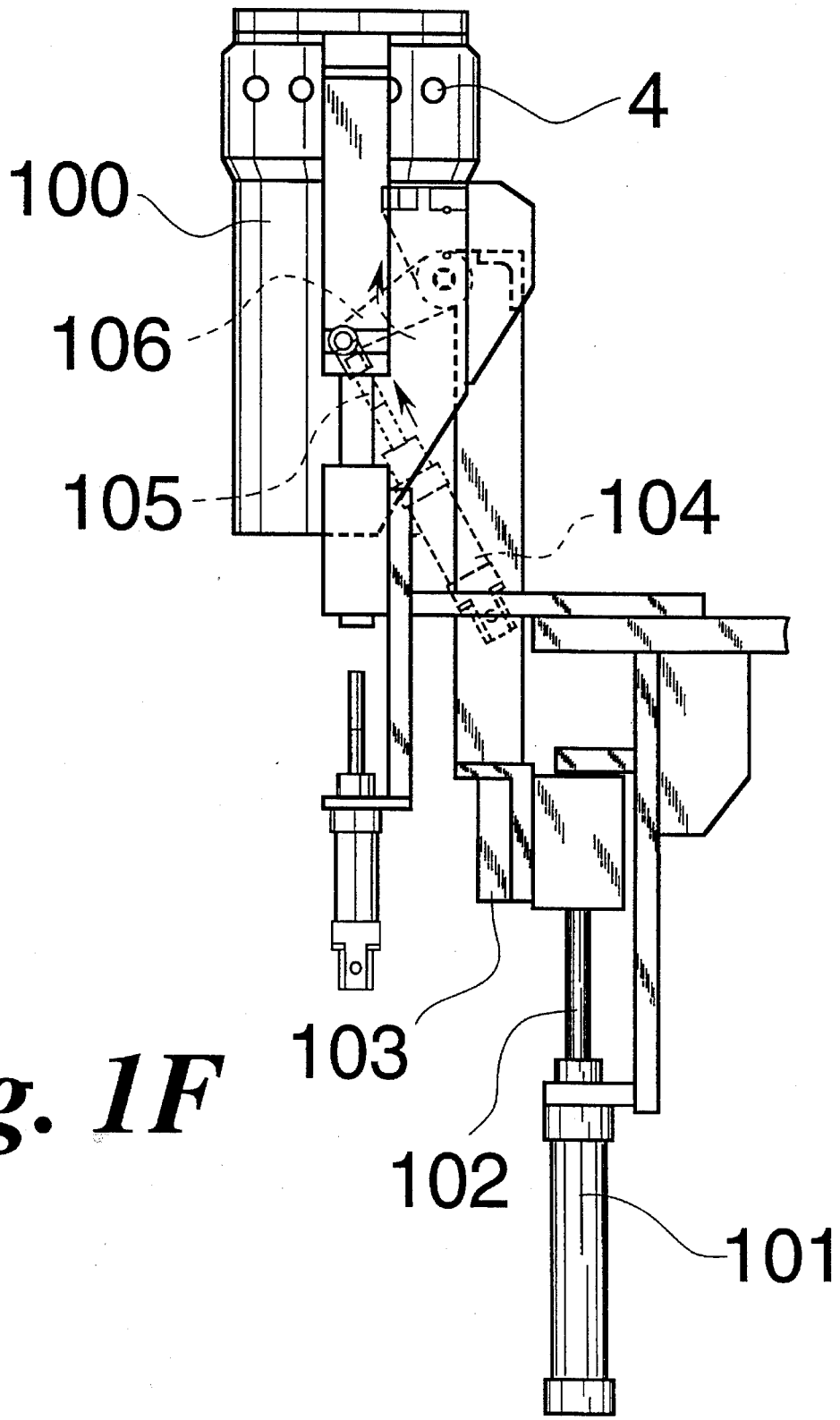
FIG. 1F shows a side view of the head of FIG. 1B.
Figure 2A:
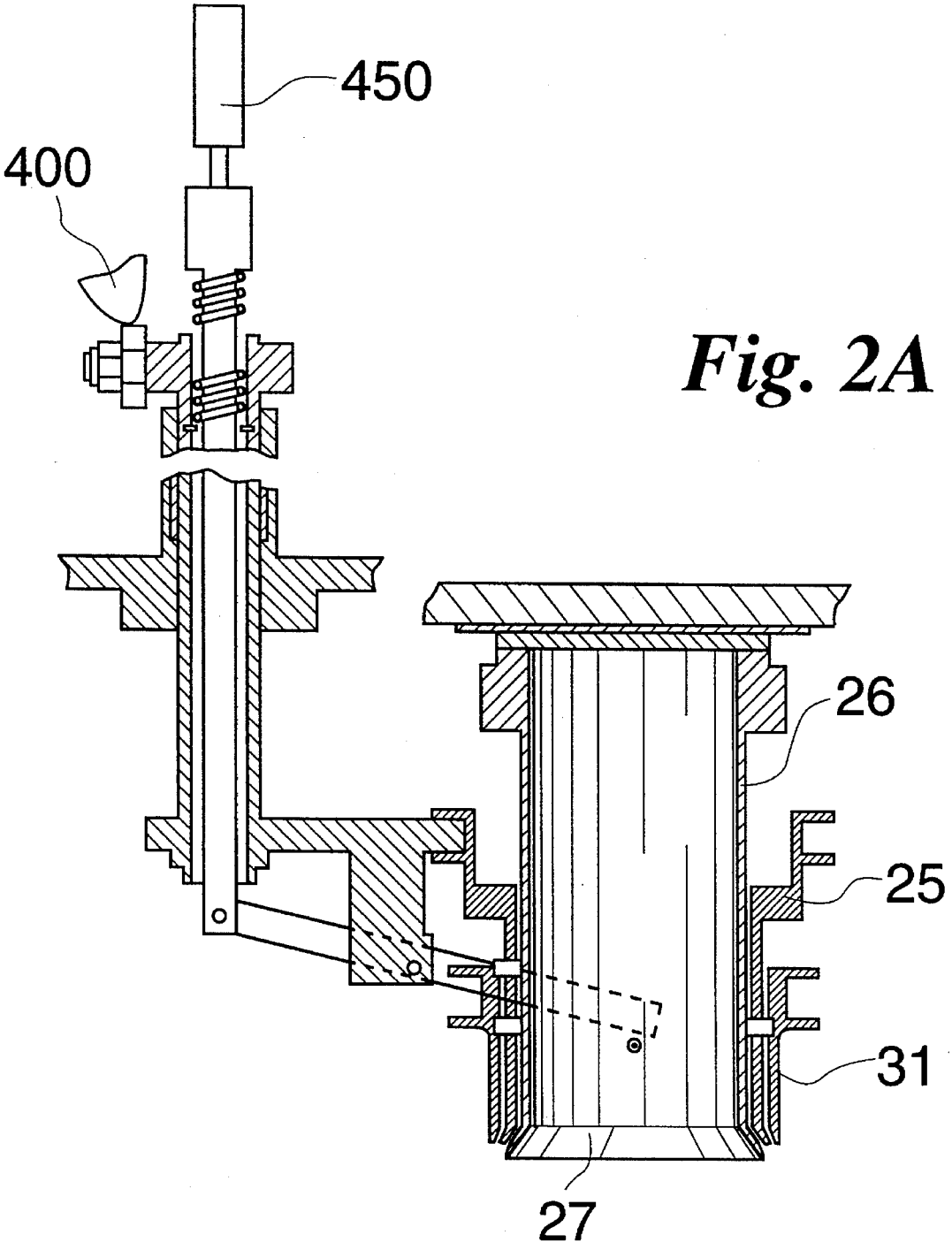
FIG. 2A is a view in longitudinal section of the pantyhose-gripping means in rest condition.
Figure 2B:
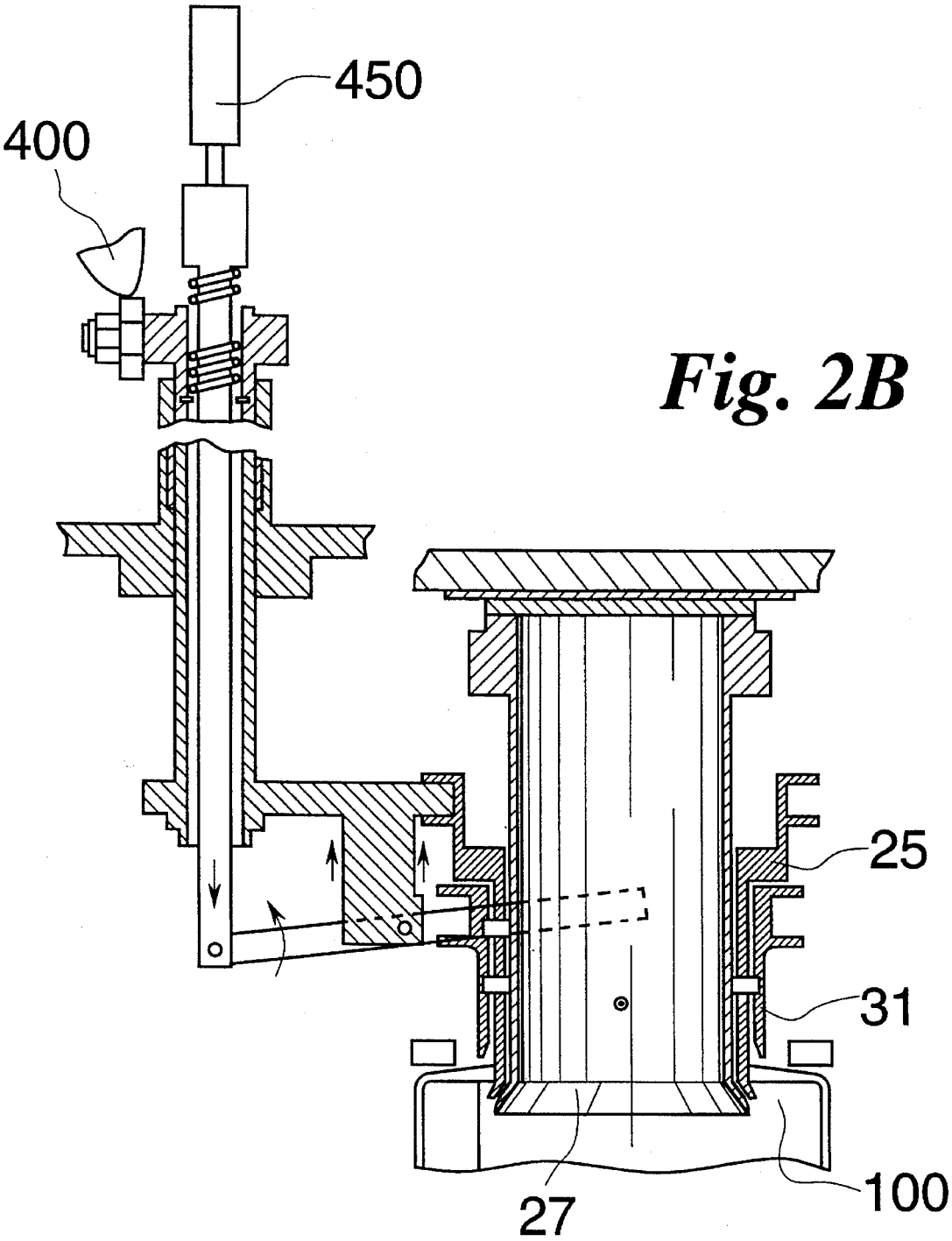
FIG. 2B is a view in longitudinal section of the means of FIG. 2A, showing the loading of the pantyhose articles.
Figure 2C:
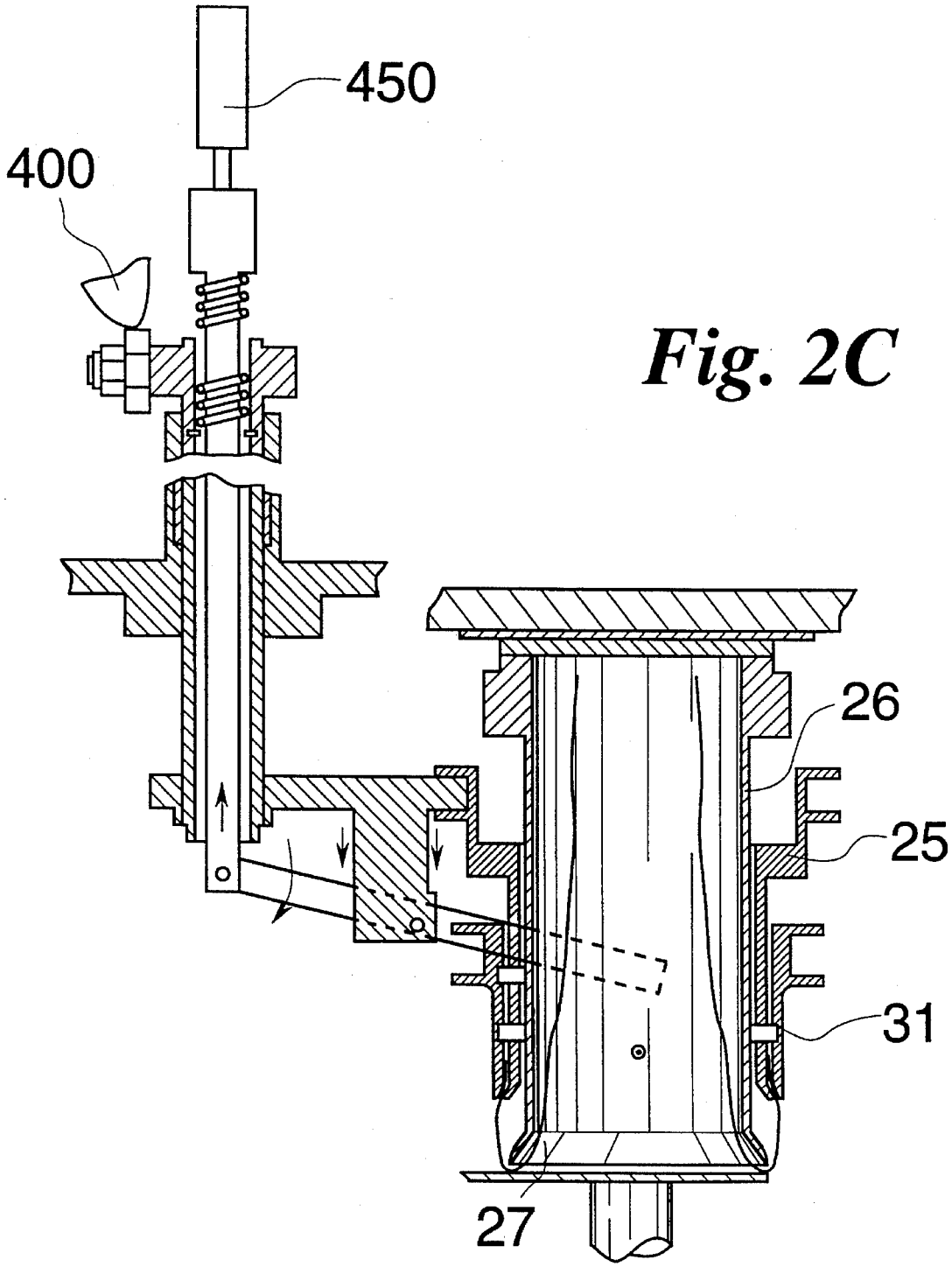
FIG. 2C is a view in longitudinal section of the means of FIG. 2A, showing the trimming of the pantyhose perineal hole.
Figure 2D:
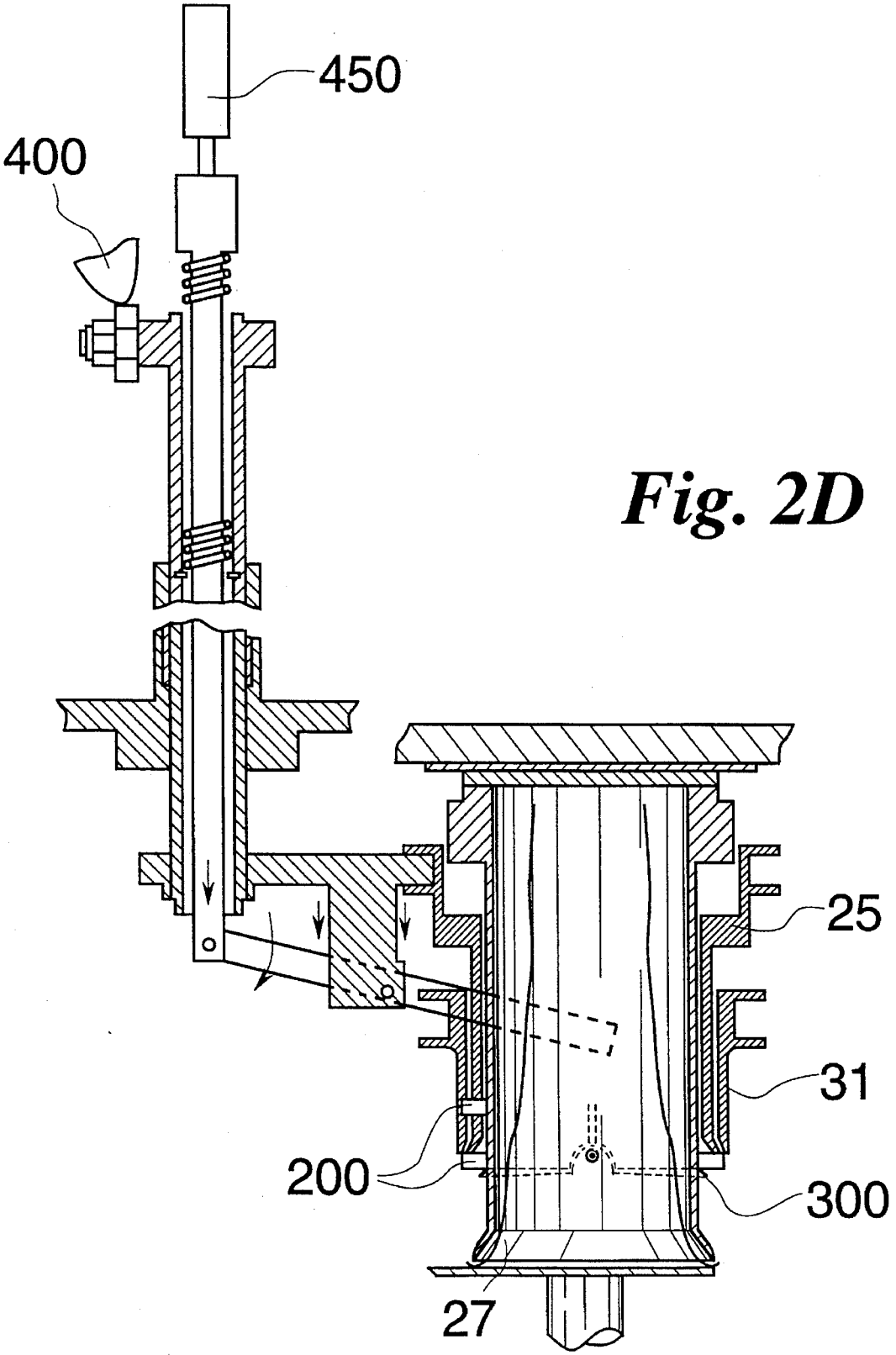
FIG. 2D is a view in longitudinal section of the means of FIG. 2A, showing the application of the gusset.
Figure 2E:
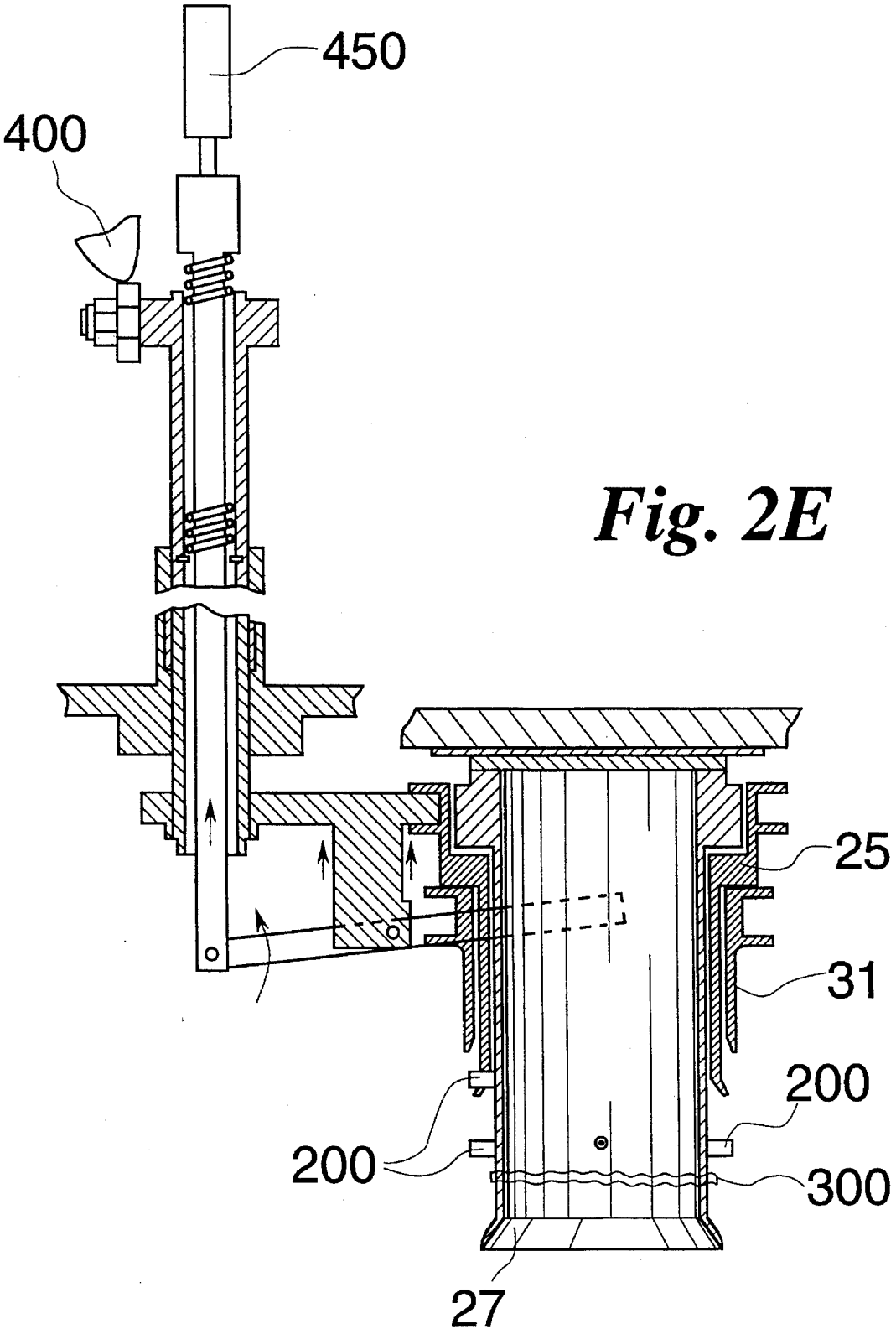
FIG. 2E is a view in longitudinal section of the means of FIG. 2A, showing the unloading of the pantyhose articles.
Figure 3A:
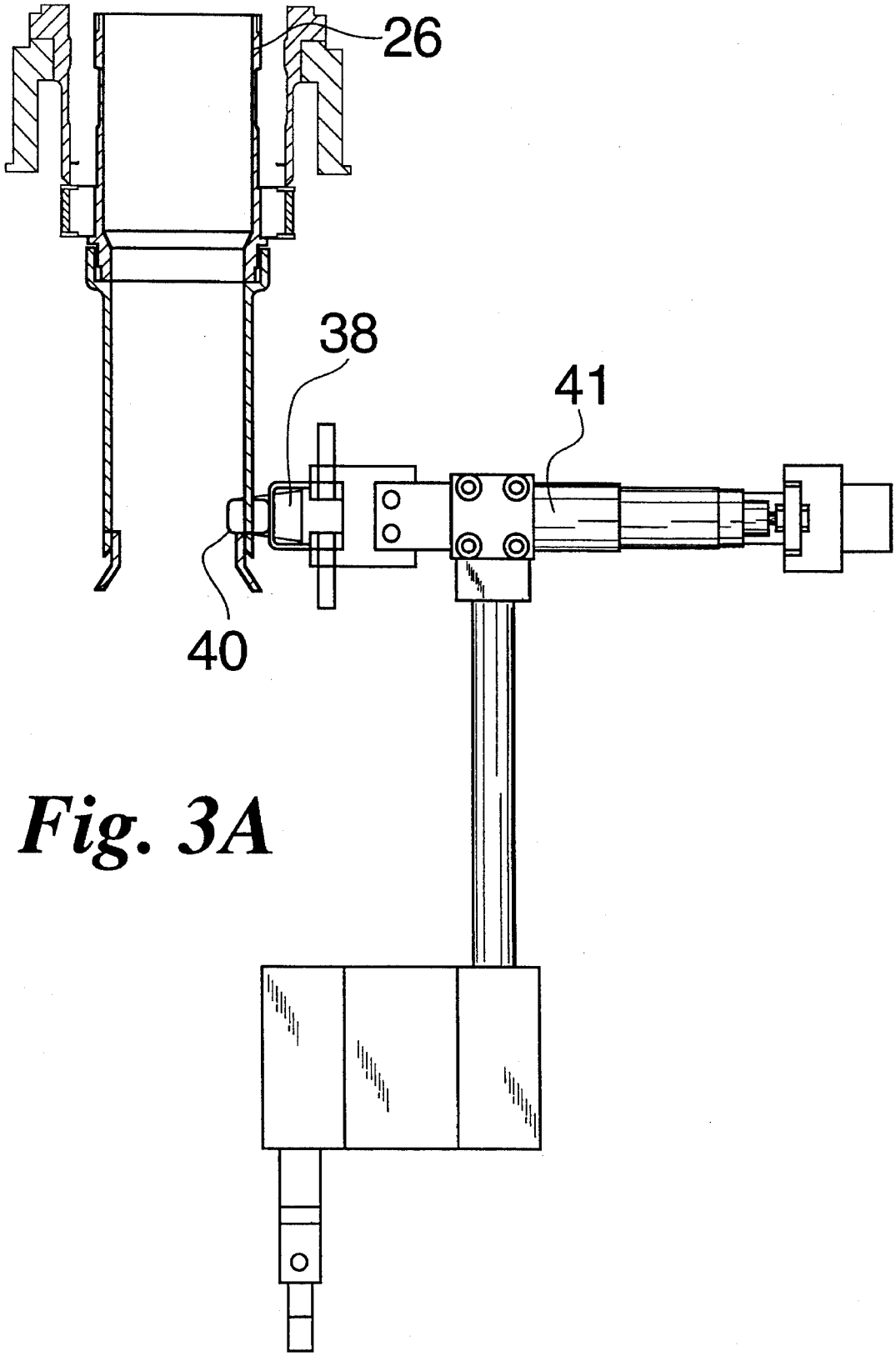
FIG. 3A shows the view in longitudinal section of the means of FIG. 2A in cooperation with the means for the cutting and removal of the waste.
Figure 3B:
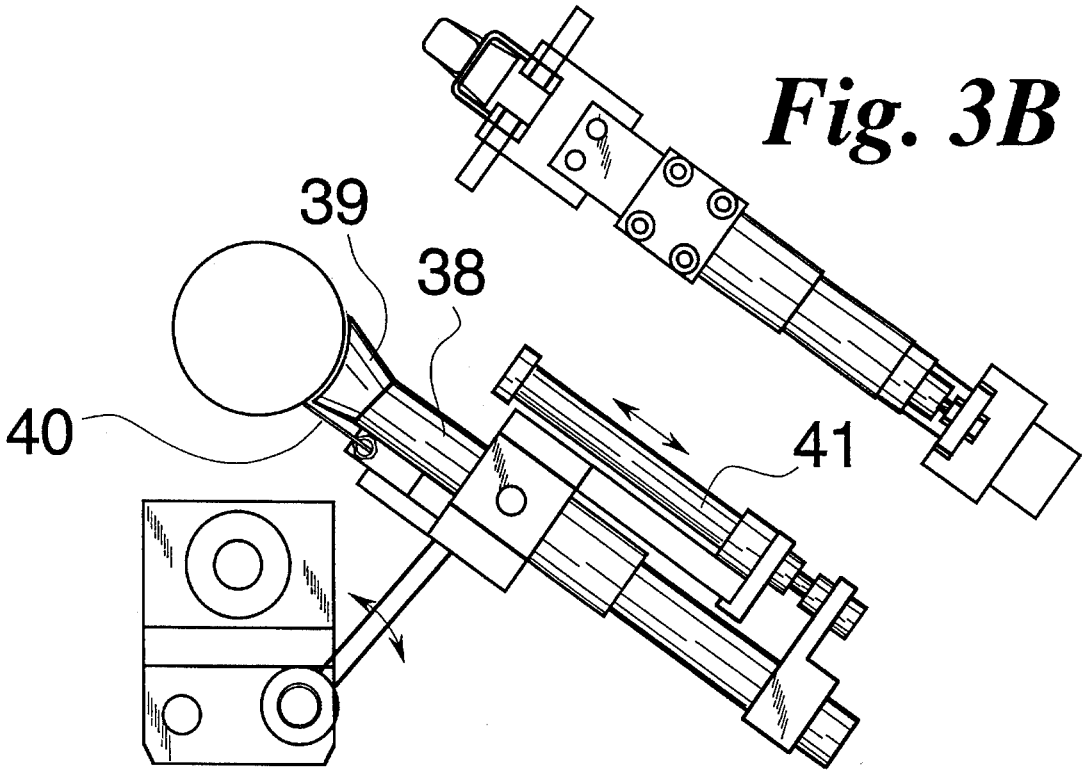
FIG. 3B shows the plan view of the means of FIG. 3A.

According to the invention, and reference being made to FIGS. 1A–1C of the attached drawings, the side wall of said head (100) is provided with a plurality of through holes (4) enabling the connection of chamber (1) with the intake manifold (2), so as to cause the pantyhose fabric to completely adhere thereto during the loading operation of the gusset-sewing machine.

Said collar (110), therefore, ensures the right positioning when carrying out the perineal hole even on very "heavy", that is, high-consistency fabric, and also prevents the sliding of the pantyhose article over the side walls of the head (100) in case said hole is of small diameter.

Advantageously, said carriage (111) is provided with lift-opposing elastic means (112) and an underlying abutment and stop element (113) which cooperates with a corresponding operating cylinder (114) to prevent same carriage from being lowered below a predetermined level.

Moreover, advantageously, according to the invention, the mouthpiece (39) of said pipe (38) is shaped like a nozzle to permit an easy suction of said waste.

Advantageously, said electrical annular resistance element (9) is fixed to the upper ends of two parallel bars (12) which are made to slide onto an isolated guide (13) parallel to the axis (a) of the head (100) by the actuation of a corresponding pneumatic cylinder (14).

It will be appreciated that said resistance element (9) is fed by a suitable electrical source via two terminal wire clamps (15). According to an alternative embodiment of the invention, said carriage (111) is supported by the same head (100).

Moreover, it is advantageously provided that said head (100) driving means may include a plurality of further operating cylinders, not shown for clarity, to allow for a uniform distribution of the work load and have them properly positioned upon the fitting of the pantyhose bodice thereon and the lifting thereof, in order to carry out the perineal hole and the feeding of the gusset-sewing machine.

According to the invention, the heads (27) of the machine, the countercones (25) and the elastic grippers (31) are provided with a plurality of pins (200) radially projecting from said heads (27), said pins (200) being slidingly housed within relevant slots parallel to the axis of the corresponding heads (27), in order to facilitate the removal of the waste (300) generated during the trimming of the hole of the pantyhose article: said pins (200) resulting disposed above the respective grippers (31) under the condition of transfer of the pantyhose article from the head (100) to the corresponding small head (27), and below the grippers (31) and countercones (25) under the conditions of application of the gusset and, respectively, of the removal of the pantyhose article.

In this way, when the pantyhose article being sewn is released from the relevant gripper (31), the pins push the surplus fabric (300) towards the resistance (40) which provides for cutting it before sucking it through the pipe (38).

The operation is as follows.

Upon the actuation of the gusset-sewing machine, the gripper (31) of the head (27) at the pantyhose loading station is disposed in opening condition. Then, the tubular head (100) is disposed in its downwardly inclined position to allow the operator to place the pantyhose article to be worked, properly centered thereon. At the end of this operation, the head (100) is disposed in its vertical position and the suction inside the chamber (1) is activated. Afterwards, the head (100) is driven into lifting motion until it intercepts the collar (110) which prevents the pantyhose article from sliding, and the annular resistance (9) is driven into lifting motion to form the perineal hole of the pantyhose article. Thereafter, the thus removed fabric is sucked through the conduit (8) and the head (100) is further lifted until it attains a position with its upper part above the countercone (25). Afterwards, the gripper (31) is lowered and closed to trap the pantyhose article, the suction inside the chamber (1) is broken off, and the head (100) together with the collar (110) are brought back to the respective initial position to allow the fitting of a new pantyhose article. At the end of the respective return travel, the head (100) is again located in the lowered position. At this point, the suction inside the head (27) is started to retain the bodice of the pantyhose article therein before the legs, the latter being held by the operator or by suitable pneumatic means. Once the loading operation is completed, the head (100) is inclined downwards to allow the fitting of another pantyhose article. During the subsequent rotation of the machine for transferring the head (27) from the loading station to the perineal hole-trimming station, the respective countercone (25) is lifted along with the relevant pantyhose article to allow the latter to be disposed at the level suitable for the trimming thereof. Upon this stage, the pins (200) will be located below the gripper (31) and countercone (25). Once the trimming is completed, the countercone (25) is lifted further up to allow the operation of the sewing means. After the subsequent eversion of the pantyhose article, the annular portion of the fabric (300), being removed by the trimming of the perineal hole, will be external to the corresponding head (27) and kept in tension by the pins (200), so as to cause the cutting thereof by the resistance element (40) moving close thereto, and the suction thereof through the mouthpiece (39) by the opening of the gripper (31).

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. Method for automatic loading of a machine for sewing gussets on pantyhose-type hosiery articles and a method for sewing comprising, in sequence, the steps of:

fitting a pantyhose article on a tubular support, said support being driven through a reciprocating vertical motion and reciprocating rotary motion about a horizontal axis;

disposing said support in a vertical position and retaining said pantyhose article closely adhering to said support by means of a stream of air aspirated from an inside of said support;

lifting said support upwardly to a level for gripping said pantyhose article by a corresponding gripping means, said gripping means being activated by movement of said support;

forming a perineal hole in the retained pantyhose article;

aspirating the fabric resulting from said perineal hole of said pantyhose article;

lifting said support further upwardly to dispose said pantyhose article in a position suitable for gripping by a gusset-sewing machine gripping element;

activating said gusset-sewing machine gripping means to allow transfer of said pantyhose article onto a gusset-sewing machine head;

stopping suction inside said tubular support;

lowering said support and deactivating said pantyhose gripping means;

aspirating a bodice portion of said pantyhose inside said sewing machine head;

inclining said tubular support to allow a new pantyhose to be fitted thereon;

trimming said perineal hole of said pantyhose article;

sewing a pantyhose backing perineal gusset;

turning said pantyhose article inside out;

cutting and aspirating an annular portion of said fabric taken out by a trimming of said perineal hole; and deactivating said pantyhose gripping means to allow removal of said pantyhose article.

2. Apparatus for sewing and for automatic loading of a machine for sewing gussets on pantyhose-type hosiery articles, the apparatus comprising:

a tubular head for supporting a bodice of a pantyhose article, said tubular head including an annular chamber connected to an intake manifold, an annular electrical resistance element for cutting an edge of the pantyhose hole provided for the gusset, and a conduit located below said electrical resistance element to suck the thus removed fabric;

alternate motion driving means for vertically driving said tubular head into an alternate motion in two directions, said driving means including a corresponding actuator cylinder having a vertical axis and being provided with a stem fixed to a bottom of a carriage for supporting said head;

horizontal driving means for driving said head about a horizontal axis, said horizontal axis being orthogonal to a slide direction of said head, said alternate motion driving means including an operating cylinder fixed to said carriage and a lever connected at one end to a stem of said cylinder and at another end to said tubular head, whereby upon withdrawal of the pantyhose article, feedback from said stem will result in clockwise and anti-clockwise rotation of said lever and said head;

a collar coaxially mounted above said head, said collar for gripping the fabric mounted thereon in cooperation with suction generated in said annular chamber;

a gusset-sewing machine head;

a carriage corresponding to said collar, said collar being fixed to said carriage and said carriage being driven into a reciprocating vertical motion for lifting and lowering in synchronism with a lifting and lowering of said tubular head, allowing gripping of said pantyhose article when said head is lifted for supplying a pantyhose article and raising said tubular head in a condition of releasing said pantyhose article;

pantyhose supporting means associated with said gusset-sewing machine head, said supporting means including a counter cone which is fitted on a vertical axis pipe to a lower end of said gusset-sewing machine head;

pantyhose gripping means including an elastic annular normally closed gripper for said gusset-sewing machine head, said gripper being supported by said counter cone;

fixed cam means for driving and lifting and lowering said counter cone;

pneumatic means for operating said gripper, said pneumatic means being disposed in a correspondence of stations for loading and respectively turning inside out said article; and means for cutting and removing waste generated during a trimming of said perineal hole including a trimming electric resistance element and a suction pipe for generating suction and means for driving said trimming element and suction pipe into a reciprocating motion close and, respectively away from a trimming station.

3. Apparatus according to claim 2, wherein said gusset-sewing machine head includes a side wall provided with a plurality of through holes, a chamber within said head being connected to said intake manifold whereby fabric of said pantyhose article completely adheres to said head during a machine loading operation.

4. Apparatus according to claim 2, wherein said carriage is provided with elastic means for opposing lifting, an underlying abutment and stop element, said elastic means and said underlying abutment and stop element cooperating with said operating cylinder to prevent said carriage from being lowered below a predetermined level.

5. Apparatus according to claim 2, wherein a mouthpiece of said pipe is shaped like a nozzle.

6. Apparatus according to claim 2, further comprising two parallel bars, an isolated guide and a corresponding pneumatic cylinder, said annular bars sliding on said isolated guide parallel to an axis of said head; said electrical annular resistance being fixed to upper ends of said parallel bars.

7. Apparatus according to claim 4, wherein said carriage is supported by said gusset-sewing machine head.

8. Apparatus according to claim 2, wherein said drive means for driving said head into motion includes a plurality of operating cylinders operated to provide a uniform distribution of work load.

9. Apparatus according to claim 2, wherein said gusset-sewing machine head said counter cone and said elastic gripper are provided with a plurality of pins radially projecting from said gusset-sewing machine head, said pins being slidably housed within slots parallel to an axis of said gusset-sewing machine head in order to facilitate removal of waste generated during trimming of said hole of said pantyhose article, said pins being disposed above said gripper during transfer of said pantyhose article from said tubular head to said gusset-sewing machine head and below said gripper and said counter cone during application of said gusset and during removal of said pantyhose article.

* * * * *

UNITED STATES PATENT AND TRADEMARK OFFICE

CERTIFICATE OF CORRECTION

PATENT NO. : 5,460,108

DATED : October 24, 1995

INVENTOR(S) : Pier Lorenzo Migliorini

It is certified that error appears in the above-identified patent and that said Letters Patent is hereby corrected as shown below:

On the title page, please correct the inventor data as follows:

[75] Inventor: Pier Lorenzo Migliorini, Arezzo, Italy

Signed and Sealed this

Twentieth Day of February, 1996

*Attest:*

*Attesting Officer*

BRUCE LEHMAN

*Commissioner of Patents and Trademarks*